United States Patent [19]

Stritzko

[11] 4,180,880

[45] Jan. 1, 1980

[54] METHOD OF PREVENTING ESCAPE OF DYE FLUID BETWEEN DYE BEAMS AND CONVOLUTED TEXTILE MATERIAL

[75] Inventor: Vilem Stritzko, Strengelbach, Switzerland

[73] Assignee: Bleiche AG Zofingen, Zofingen, Switzerland

[21] Appl. No.: 841,946

[22] Filed: Oct. 13, 1977

[30] Foreign Application Priority Data

Oct. 20, 1976 [CH] Switzerland ..... 13288/76

[51] Int. Cl.[2] ..... D06B 5/22

[52] U.S. Cl. ..... 8/154; 68/198

[58] Field of Search ..... 8/154, 155.1; 68/189, 68/198; 242/118.1

[56] References Cited

U.S. PATENT DOCUMENTS

| | | | |
|---|---|---|---|
| 1,921,123 | 8/1933 | Herrmann | 68/198 |
| 2,671,332 | 3/1954 | Zingg | 68/198 |
| 3,097,515 | 7/1963 | Claiborne | 68/198 |

FOREIGN PATENT DOCUMENTS

| | | | |
|---|---|---|---|
| 796247 | 6/1958 | United Kingdom | 8/154 |

*Primary Examiner*—Philip R. Coe

*Attorney, Agent, or Firm*—Peter K. Kontler

[57] ABSTRACT

A dye beam for a roll of convoluted textile material has a foraminous tube whose end portions extend beyond the axial ends of the roll and whose apertures admit dye fluid into the roll in response to admission of pressurized fluid into its interior. A circumferentially complete or spirally convoluted impermeable elastic sleeve surrounds each end portion of the tube and the inner end of each sleeve is confined within the roll. The outer ends of the sleeves are sealingly clamped to the external surface of the tube and the inner ends of the sleeves are held against appreciable movement away from each other so that they remain within the confines of the roll. To this end, the inner ends are connected to each other by bands or by a foraminous hose, the inner ends are anchored in the tube, the inner ends are bonded to or interleaved with the end cloth which is convoluted around the tube within the roll, or the exposed portions of the sleeves are surrounded by annuli of plates which are pivoted to the axial ends of the tube and are overlapped by the end portions of the end cloth. When the pressurized dye fluid issues from the tube and penetrates into the roll, some of the fluid causes limited radial expansion of the sleeves; however, the sleeves prevent escape of dye fluid by a route other than through the roll.

6 Claims, 8 Drawing Figures

METHOD OF PREVENTING ESCAPE OF DYE FLUID BETWEEN DYE BEAMS AND CONVOLUTED TEXTILE MATERIAL

BACKGROUND OF THE INVENTION

The present invention relates to the treatment of webs of convoluted textile material, and more particularly to improvements in a method of supporting webs of convoluted textile material in dye kettles or analogous vessels for dye fluid.

Webs of textile material which is placed into a dye fluid are supported on so-called dye beams, i.e., on hollow tubular bodies whose axial passages receive pressurized dye fluid and which allow such fluid to penetrate into the convolutions of the webs thereon. In many instances, the innermost portion of a convoluted web is connected or adjacent to the outer end of a forerunner or end cloth which also consist of foraminous textile or other flexible material and directly surrounds the external surface of the dye beam. A serious drawback of presently known dye beams is that, when the pressurized dye fluid penetrates therethrough, the fluid lifts the innermost convolution of the web or the end cloth off the external surface of the dye beam whereby the lifted-off convolution and the external surface of the dye beam define a channel which extends in parallelism with the axis of the dye beam and permits escape of a high percentage of pressurized dye fluid, i.e., such fluid does not penetrate into and through the convoluted web. In fact, the quantity of dye fluid which escapes by way of the just mentioned channel often exceeds the quantity of fluid which penetrates through the convoluted web. The result is an uneven distribution of coloring matter at the ends and/or sides of the web. In some instances, a channel between the external surface of the tubular body and the innermost convolution of the web will develop as a result of sagging of the roll of convoluted textile material or as a result of previous deformation of the roll.

Proposals to avoid the formation of channels between the dye beams and the inner convolutions of webs of textile material include convoluting the web with a varying degree of tension so as to reduce the extent of radial expansion of the dye beam in response to the pressure of dye fluid which is admitted into the interior of the dye deam and flows radially outwardly therefrom. It was also proposed to provide plate-like baffles or shields at the ends of the convoluted web and to bias such parts against the respective end faces of convoluted textile material. Finally, it is also known to employ covers made of sheet metal and serving to cause a certain amount of overlap between the convoluted textile material and the loci where the dye fluid escapes by flowing axially of the dye beam. All such proposals are either totally ineffective or their beneficial effect is negligible.

OBJECTS AND SUMMARY OF THE INVENTION

An object of the invention is to provide a novel and improved method of controlling the outflow of dye fluid from the tube which supports a roll of convoluted textile material.

An ancillary object of the invention is to provide a method of the just outlined character which insures more economical utilization of dye fluid than heretofore known methods.

One feature of the invention resides in the provision of a method of controlling the flow of pressurized dye fluid from the interior of a foraminous (e.g., apertured) tube whose external surface is surrounded by a roll of convoluted textile material intermediate the axial ends of the tube. The method comprises the steps of establishing a deformable and at least substantially impermeable barrier (externally of the tube) between each axial end of the tube and the interior of the respective axial end of the roll (the barriers may constitute circumferentially complete or spirally convoluted sleeves consisting of elastomeric material), and maintaining the barriers in sealing engagement with the tube in regions spaced apart from the respective axial ends of the roll so that the fluid which flows outwardly through the foraminous tube to effect at least some radial expansion of the barriers and to bias the thus deformed or expanded barriers toward the interior of the roll is prevented from escaping axially between the interior of the roll and the external surface of the tube. The method preferably includes the additional step of holding the barriers against appreciable movement away from each other so that the inner ends of the barriers remain within the confines of the respective axial ends of the roll.

The method may further comprise the steps of convoluting a foraminous end cloth or forerunner between the external surface of the tube and the interior of the roll, and confining portions of the barriers between at least two neighboring convolutions of the end cloth. The axial length of the convoluted end cloth preferably exceeds the axial length of the roll, and both axial ends of the convoluted end cloth preferably extend outwardly beyond the respective axial ends of the roll. Still further, the method may comprise the step of reinforcing the axial ends of the end cloth to thereby control the extent of radial expansion of the corresponding portions of the barriers. Such reinforcing step may include confining strips of sheet metal or other suitable reinforcing material between neighboring convolutions of the end cloth around the respective barriers.

The novel features which are considered as characteristic of the invention are set forth in particular in the appended claims. The dye beam itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
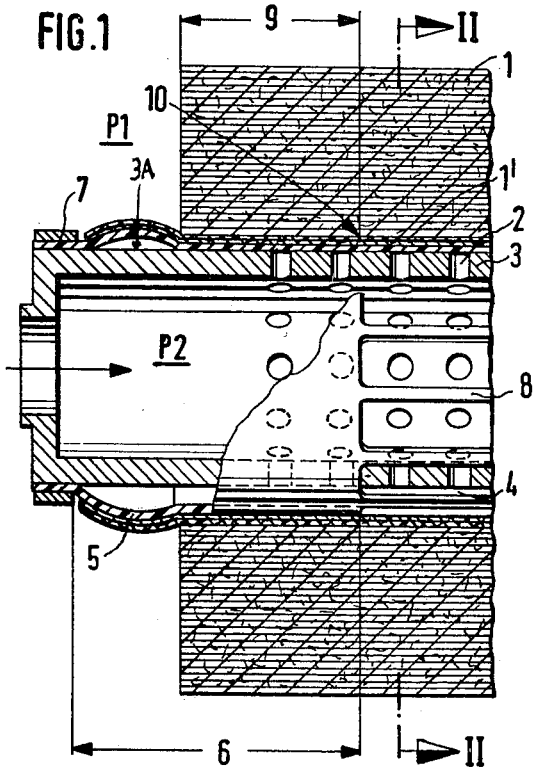
FIG. 1 is a fragmentary partly elevational and partly longitudinal sectional view of a first dye beam.
Figure 2:
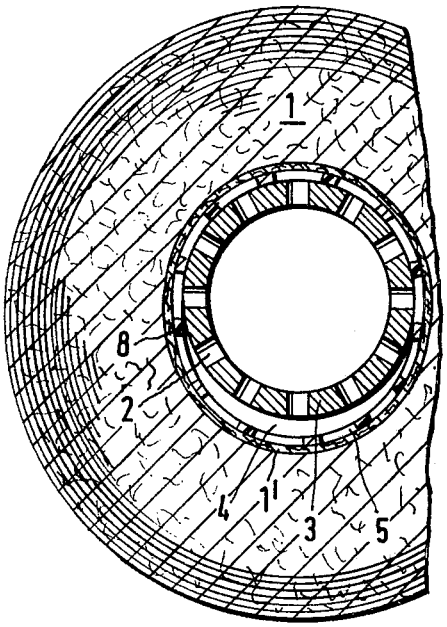
FIG. 2 is a transverse sectional view as seen in the direction of arrows from the line II—II of FIG. 1.

FIGS. 1 and 2 show a dye beam which comprises a foraminous tube 3 having radially extending apertures 2 surrounded by a roll 1 consisting of a web of convoluted textile material. A forerunner or end cloth 1' which consists of suitable textile material is connected to the inner end portion of the web which forms the roll 1, and the convolution or convolutions of the end cloth 1' are immediately adjacent to the external surface 3A of the tube 3 when the apertures 2 do not discharge pressurized fluid against the end cloth. The roll 1 surrounds the median section of the external surface 3A, i.e., the end sections of such surface extend beyond the respective axial ends of the roll.

The pressure of dye fluid in the interior of the tube 3 equals P2, and the pressure at the outer side of the tube 3 equals P1. The pressure P2 exceeds the pressure P1, i.e., the force with which the fluid penetrates through the apertures 2 equals P2 minus P1=ΔP. When the rate at which dye fluid flows through the apertures 2 is constant, ΔP is a function of the resistance which the end cloth 1' and the roll 1 offer to the flow of fluid from the interior of the tube 3. The streams of dye fluid which issue from the apertures 2 impinge upon the innermost convolution or convolutions of the end cloth 1' and expand such convolutions so that the end cloth and the external surface 3A define a sickle-shaped or crescent-shaped channel 4 which extends in the axial direction of the tube 3. The formation of channel 4 entails a certain distortion of the roll 3, i.e., at least the internal surface of the roll 1 is not a circular cylindrical surface. In many presently known dye beams, the channel between the roll of convoluted textile material and the foraminous tube or between the tube and the end cloth allows fluid to escape at a rate which exceeds the rate of penetration into the material of the roll.

The dye beam further comprises two elastically deformable, impermeable, circumferentially complete sleeve-like sealing elements or barriers 5 (one shown in each of FIGS. 1 and 2) which are disposed at and surround the respective end portions of the tube 3. Each sealing element 5 (hereinafter called sleeve for short) can be lifted off the external surface 3A of the tube 3 in a region 6 which extends from a locus close to the respective end of the tube and into the interior of the respective end portion of the roll 1. The inner end portion of each sleeve 5 overlies at least some of the apertures 2 in the tube 3. The overlapped apertures 2 are located within the confines of the convoluted end cloth 1' and also within the confines of the roll 1. The outer end portion of each sleeve 5 is sealingly secured to the respective end section of the external surface 3A by a suitable fastening device, e.g., a clamping collar or ring 7 which biases the end portion of the sleeve against the tube 3.

The inner ends 10 of both sleeves 5 are held against appreciable or any movement away from each other by relatively narrow elongated bands 8 which extend in parallelism with the axis of the tube 3 and are preferably distributed in such a way that they do not interfere with the outflow of dye fluid from the interior of the tube. This is clearly shown in each of FIGS. 1 and 2. The purpose of the bands 8 is to prevent axial shifting of the sleeves 5 away from each other and to thus prevent the inner portions of the sleeves from slipping axially out of the confines of the respective end portions of the roll 1 and end cloth 1'. The bands 8 may consist of an elastomeric material; in fact, they may be made integral with the sleeves 5.

That portion of the roll 1 which surrounds the illustrated sleeve 5 is designated by the character 9. The overall length of the sleeve 5 equals the length of the portion 9 plus the distance between the respective end face of the roll 1 and the outer end face of the respective clamping collar 7.

The pressure (P2) in the interior or the tube 3 equals or very closely approximates the pressure in the channel 4. Therefore, the sleeve 5 is caused to expand radially in the region 6 between the bands 8 and the respective clamping collar 7. The inner portion of the expanded sleeve 5 bears against the innermost convolution of the end cloth 1' along the length 9. As shown in FIG. 1, the end cloth 1' can extend axially beyond the roll 1. The force with which the expanded sleeve 5 bears against the innermost convolution of the end cloth 1' equals ΔP. Such force increases in a direction toward the illustrated end face of the roll 1 because the static pressure decreases in a direction from the inner end 10 of the sleeve 5 toward the corresponding collar 7. This is shown diagrammatically in the lower left-hand portion of FIG. 3.

When the illustrated sleeve 5 is expanded, i.e., while the fluid flows from the interior of the tube into the end cloth 1' and roll 1, the bands 8 hold the illustrated sleeve against any or against appreciable axial movement away from the other sleeve. As mentioned above, this prevents the fluid from moving the end portion 10 axially toward the collar 7. Consequently, the fluid cannot escape by flowing axially of the channel 4; such fluid merely expands the sleeve 5 and all of the fluid which is admitted into the channel 4 upon completion of expansion of the sleeve (to the extent determined by elasticity of the bands 8 and the tension of the end cloth) is compelled to flow outwardly through the end cloth 1' and roll 1. The fact that the sleeve 5 prevents or need not permit direct flow of fluid from neighboring apertures into the respective end portion of the end cloth 1' and roll 1 does not adversely influence the dyeing operation. It has been found that this dye beam (this term is intended to denote the tube 3, the two sleeves 5, the two clamping collars 7 and the bands 8) insures much more uniform dyeing of the entire roll 1 than the heretofore known dye beams, especially in the regions of both axial ends and end faces of the roll. Furthermore, the sleeves 5 invariably prevent uncontrolled escape of dye fluid irrespective of the size and/or shape of the channel and regardless of whether the channel develops as a result of radial expansion of sleeves in response to admission of pressurized fluid, in response to sagging of the web of textile material and/or for other reasons.

Figure 3:
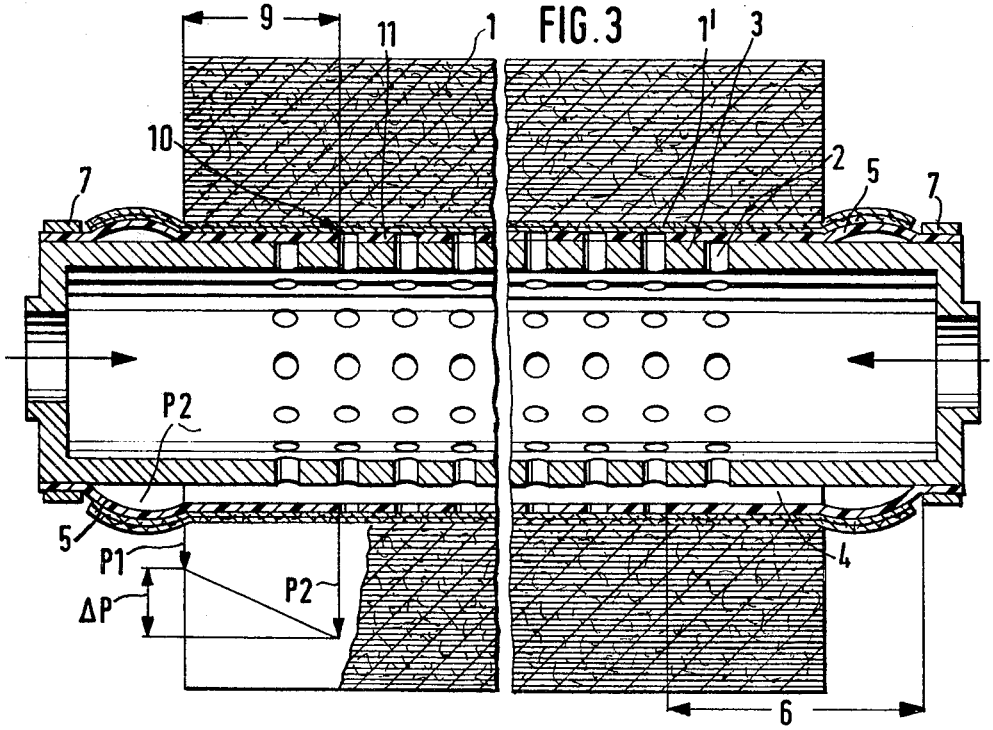
FIG. 3 is a fragmentary axial sectional view of a modified dye beam.

The dye beam of FIG. 3 constitutes a first modification of the structure which is shown in FIGS. 1 and 2. All such parts of the dye beam of FIG. 3 which are identical with or clearly analogous to corresponding parts of the dye beam of FIGS. 1 and 2 are denoted by similar reference characters. The sole important difference between the two dye beams is that the bands 8 of FIGS. 1–2 are replaced with a holding means consisting of a perforated tubular member or hose 11 which is preferably integral with the sleeves 5, i.e., the material of the hose 11 can exhibit the same elasticity as the material of the sleeves. In all other respects, the dye beam of FIG. 3 is identical with the first-described dye beam. FIG. 3 further shows that pressurized dye fluid can be admitted at both axial ends of the tube 3.

Figure 4:
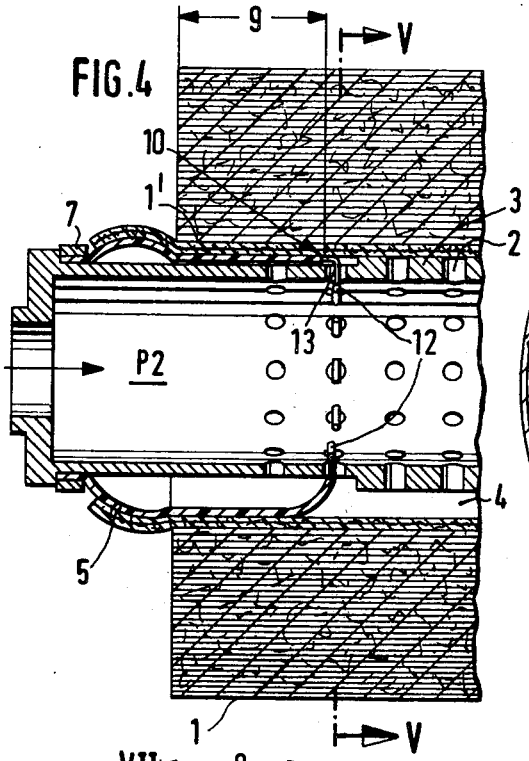
FIG. 4 is a fragmentary axial sectional view of a third dye beam.
Figure 5:
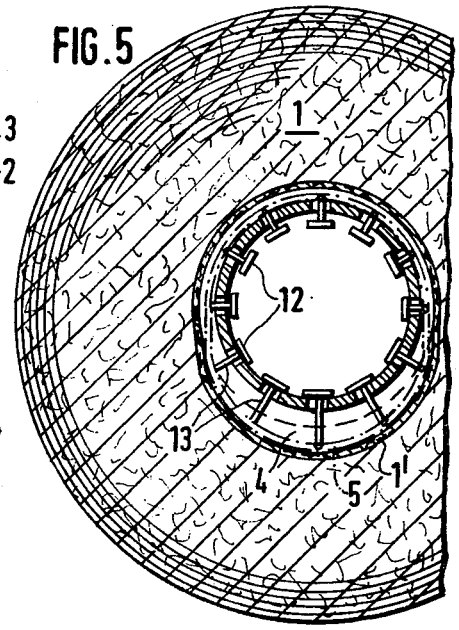
FIG. 5 is a transverse sectional view as seen in the direction of arrows from the line V—V of FIG. 4.

FIGS. 4 and 5 show a third dye beam wherein the hose 11 of FIG. 3 or the bands 8 of FIGS. 1–2 are replaced with a holding means serving to anchor the inner ends 10 of the sleeves 5 in the tube 3. The holding or anchoring means includes retainers 12 which are located in the interior of the tube 3 and serve to hold the inner ends 10 of sleeves 5 against appreciable axial movement toward the respective collars 7. The retainers 12 are short pins which are secured to flexible cord-like extensions 13 at the inner ends 10 of the sleeves 5 (only one shown). The extensions 13 pass inwardly through the neighboring apertures 2 and into the interior of the tube 3 and are secured to the associated pins 12.

Since the length of the pins 12 exceeds the diameters of the respective apertures 2, the inner ends 10 of the sleeves 5 are safely held against excessive axial movement toward the associated collars 7 when the sleeves are expanded by dye fluid flowing from the interior of the tube 3. The neighboring extensions 13 at the end 10 of each collar 5 are preferably equidistant from each other. The length of each extension 13 suffices to allow for some expansion of the ends 10 of the sleeves 5 in response to the flow of dye fluid through the apertures 2.

Figure 6:
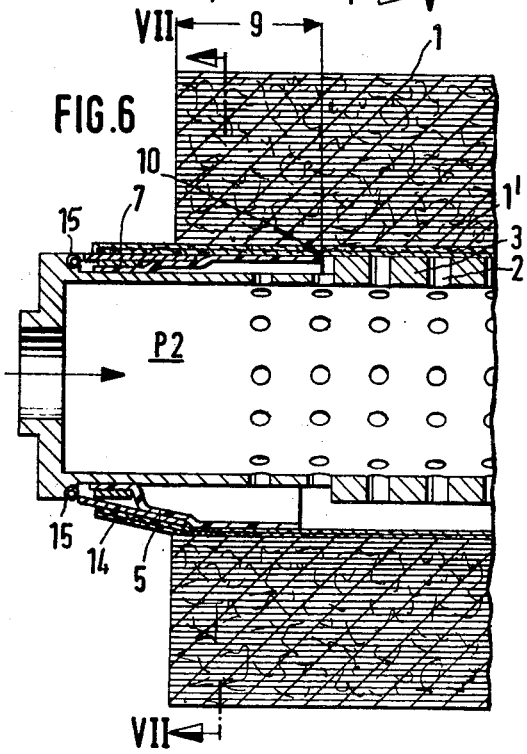
FIG. 6 is a fragmentary axial sectional view of a fourth dye beam.
Figure 7:
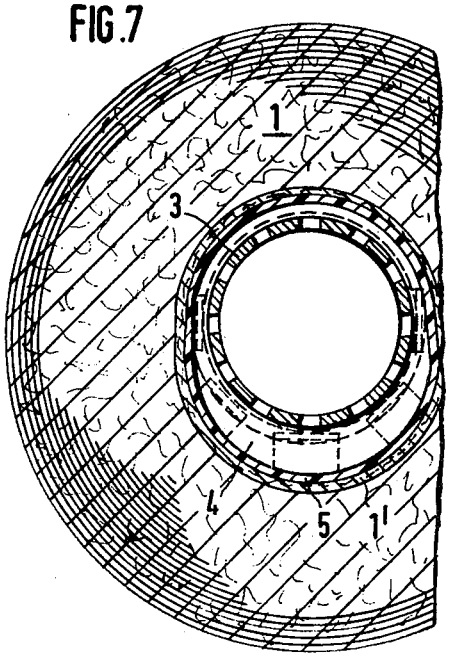
FIG. 7 is a transverse sectional view as seen in the direction of arrows from the line VII—VII of FIG. 6.

FIGS. 6 and 7 illustrate a further dye beam wherein the inner ends 10 of the circumferentially complete sleeves 5 (only one shown) are held against axial movement toward the respective collars 7 by pivotable flaps 14 which are articulately connected to the respective ends of the tube 3 by hinges 15 or in another suitable way. Those end portions of the flaps 14 which are remote from the respective collars 7 are overlapped by the marginal portions of the innermost convolutions of the roll. Furthermore, the marginal portions of the end cloth 1' preferably extend beyond the respective end faces of the roll 1, i.e., they overlie relatively large portions of the respective set of flaps 14. Each flap 14 is an elongated plate, and each set of flaps forms a substantially funnel-shaped or basket-like structure which limits the extent of radial expansion of the respective sleeve 5 in the region located inwardly of the associated collar 7. The flaps 14 of each set are preferably equally spaced apart from each other (see FIG. 7). It has been found that the flaps 14 constitute an effective substitute for the hose 11, bands 8 and/or retainers 12, i.e., they insure that the ends 10 of the sleeves 5 remain within the confines of the roll 1 while the dye fluid flows from the interior of the tube 3 via apertures 2 and into the material of the end cloth 1' and roll 1.

Figure 8:
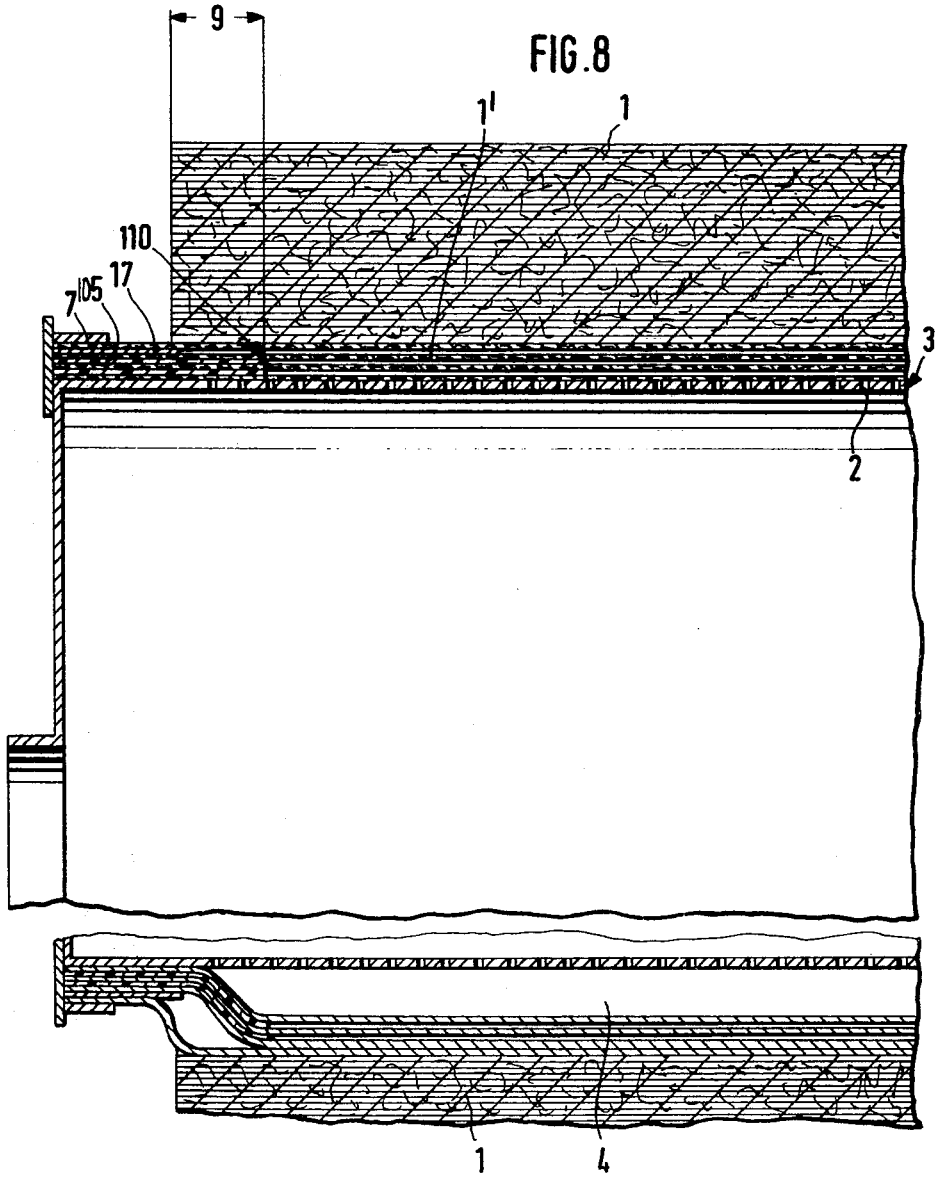
FIG. 8 is fragmentary axial sectional view of a fifth dye beam.

FIG. 8 shows a further embodiment of the dye beam wherein the end cloth 1' extends substantially all the way to the ends of the tube 3. The illustrated sleeve 105 is an elastic band or strip which is placed between two or more convolutions of the end cloth 1' and is coiled as a result of winding of the end cloth around the tube 3. The end cloth 1' constitutes a support for the sleeve 105 and a holding means which prevents the inner end 110 of the sleeve from sliding outwardly toward the respective end of the tube 3. A sheet metal reinforcing strip 17 is coiled around band 105; this strip 17 is placed between the neighboring convolutions of the end cloth 1' so that it forms a tubular confining sheath for the sleeve 105. The width of the reinforcing strip 17 is somewhat less than the axial length of the sleeve 105, and the strip 17 extends all the way, or at least close, to the respective axial end of the tube 3. A clamping collar 7 surrounds the strip 17 in the region of the respective end of the tube 3 to insure that the outer end portion of the sleeve 105 is held against axial movement. The inner end of the strip 17 extends into the roll 1. It will be noted that the collar 7 is placed around the outermost portion of the end cloth 1', i.e., the collar 7 biases the end cloth, the sleeve 105 and the strip 17 against the respective end section of the external surface of the tube 3.

The reinforcing strip 17 is optional, i.e., it can be omitted under certain circumstances. It is further possible to dispense with a discrete sleeve 105 at each axial end of the tube 2; instead, elastic layers (which constitute the sleeves 105) can be bonded (e.g., vulcanized) to the marginal portions of the end cloth 1' so that the end cloth and the two spiral sleeves form an integral unit.

When the interior of the tube 3 receives dye fluid at an elevated pressure (P2), the innermost convolution of the end cloth 1' is lifted off the external surface of the tube 3; however, the dye fluid cannot escape by flowing axially toward the ends of the tube because the sleeves 15 constitute non-permeable sealing elements or barriers which intercept a certain amount of fluid and compel the fluid which continues to issue via apertures 2 to penetrate into the material of the end cloth 1' and roll 1. Dye fluid which escapes at the end faces of the roll 1 must flow through the material of the end cloth 1' and roll 1, i.e., such fluid can escape only by flowing radially outwardly beyond the inner ends 110 of the sleeves 105 and thereupon axially toward the respective end faces of the roll 1.

The reinforcing strips 17 prevent excessive (or any) expansion of the sleeves 105 in the regions which are located outwardly of the roll 1, as considered in the axial direction of the tube 3. Pronounced expansion of such portions of the sleeves 105 is undesirable because the inner ends 110 could slide axially toward the respective clamping collars 7. Moreover, excessive or appreciable radial expansion of the sleeves 105 could generate pronounced axial stresses upon the roll 1; this could result in folding or creasing of the convoluted web as well as in non-uniform dyeing of the textile material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. A method of controlling the flow of pressurized dye fluid from the interior of a foraminous tube whose external surface is surrounded by a roll of convoluted textile material intermediate the axial ends thereof, comprising the steps of establishing a deformable and at least substantially impermeable tubular barrier externally of the tube between each axial end of the tube and the interior of the respective axial end of the roll so that a tubular zone of the barrier extends into the interior and overlaps the respective axial end of the roll from within; and maintaining the barriers in sealing engagement with the tube in regions spaced apart from the respective axial ends of the roll so that the fluid which flows outwardly through the foraminous tube effects at least some radial expansion of the barriers and biases the tubular zones of the barriers against the roll from within but is prevented from escaping by flowing axially between the interior of the roll and the external surface of the tube.

2. A method as defined in claim 1, further comprising the step of holding the barriers against axial movement from the interior of the roll.

3. A method of controlling the flow of pressurized dye fluid from the interior of a foraminous tube whose external surface is surrounded by a roll of convoluted textile material intermediate the axial ends thereof, comprising the steps of establishing a deformable and at least substantially impermeable tubular barrier externally of the tube between each axial end of the tube and the interior of the respective axial end of the roll, including convoluting a foraminous end cloth between the interior of the roll and the tube, confining portions of the barriers between at least two neighboring convolutions of the end cloth, and holding the barriers against axial movement from the interior of the roll; and maintaining the barriers in sealing engagement with the tube in regions spaced apart from the respective axial ends of the roll so that the fluid which flows outwardly through the foraminous tube effects at least some radial expansion of the barriers and biases the barriers toward the interior of the roll but is prevented from escaping by flowing axially between the interior of the roll and the external surface of the tube.

4. A method as defined in claim 3, wherein the axial length of the convoluted end cloth exceeds the axial length of the roll and both axial ends of the convoluted end cloth extend outwardly beyond the respective axial ends of the roll.

5. A method as defined in claim 4, further comprising the step of reinforcing the axial ends of the end cloth to thereby control the extent of radial expansion of corresponding portions of the barriers.

6. A method as defined in claim 5, wherein said reinforcing step includes confining strips of reinforcing material between neighboring convolutions of the end cloth around the respective barriers.

* * * * *